United States Patent [19]

Knight, Jr. et al.

[11] Patent Number: 5,050,480

[45] Date of Patent: Sep. 24, 1991

[54] TRIGGER ASSEMBLY FOR A FIREARM

[75] Inventors: C. Reed Knight, Jr., Vero Beach; Eugene M. Stoner, Palm City, both of Fla.

[73] Assignee: Kniarmco Inc., Vero Beach, Fla.

[21] Appl. No.: 447,601

[22] Filed: Dec. 8, 1989

[51] Int. Cl.[5] ..... F41A 19/35

[52] U.S. Cl. ..... 89/147; 89/14.3; 89/163; 42/7

[58] Field of Search ..... 89/147, 163, 180; 42/7

[56] References Cited

U.S. PATENT DOCUMENTS

| | | | |
|---|---|---|---|
| 566,513 | 8/1896 | Gates | 42/7 |
| 882,594 | 3/1908 | Talbot | 89/150 |
| 984,519 | 2/1911 | Browning | 89/163 |
| 990,475 | 4/1911 | Cuccurullo | 89/147 |
| 1,395,455 | 11/1921 | Searle | 42/7 |
| 1,427,966 | 9/1922 | Nickl | 89/163 |
| 1,521,286 | 12/1924 | Fisher | 42/69.01 |
| 1,664,788 | 4/1928 | Oberhammer | 89/147 |
| 2,139,203 | 12/1938 | Petter | 42/69.03 |
| 2,464,010 | 3/1949 | Vonella | 89/129 |
| 2,716,923 | 9/1955 | Gaidos | 42/69.02 |
| 2,890,626 | 6/1959 | Amsler | 89/180 |
| 3,678,800 | 7/1972 | Seidel et al. | 89/147 |
| 3,726,040 | 4/1973 | Cranston | 42/69.01 |
| 3,756,120 | 9/1973 | Roy | 89/163 |
| 3,857,325 | 12/1974 | Thomas | 89/138 |
| 4,031,648 | 6/1977 | Thomas | 42/70.02 |
| 4,201,113 | 5/1980 | Seecamp | 89/199 |
| 4,203,348 | 5/1980 | Sokolovsky | 89/148 |
| 4,301,609 | 11/1981 | Peterson et al. | 42/69.02 |
| 4,326,353 | 4/1982 | Lugwig et al. | 42/7 |
| 4,358,987 | 11/1982 | Wihelm | 89/196 |
| 4,420,899 | 12/1983 | Bourlet et al. | 42/70.02 |
| 4,522,107 | 6/1985 | Woodcock et al. | 89/196 |
| 4,646,619 | 3/1987 | Sokolvsky | 89/145 |
| 4,703,826 | 11/1987 | Byron | 89/188 |
| 4,754,689 | 7/1988 | Grehl | 89/196 |
| 4,825,744 | 5/1989 | Glock | 89/145 |

FOREIGN PATENT DOCUMENTS

| | | | |
|---|---|---|---|
| 442513 | 11/1948 | Italy | 89/180 |
| 83936 | 5/1954 | Norway | 89/161 |

*Primary Examiner*—Stephen C. Bentley
*Attorney, Agent, or Firm*—Carroll F. Palmer

[57] ABSTRACT

The safety of semi-automatic pistols and like firearms is improved by making them double action only combined with novel features that include use of roller bearings for support of trigger and sear assemblies, structuring them for constant pressure trigger pull, automatic blocking the firing pin from reaching the cartridge until the firearm is fully locked in the battery position and structuring operation of the sear so it can engage the firing pin only when the trigger pulls it rearward.

12 Claims, 6 Drawing Sheets

TRIGGER ASSEMBLY FOR A FIREARM

BACKGROUND OF THE INVENTION

1. Field of the Invention

This application relates to semi-automatic firearms with improved safety features. More particularly it concerns hand-held or shouldered semi-automatic guns of the double action only type.

2. Description of Related Art

It is well known by police, military and other users of semi-automatic handguns that their accidental discharge is a very serious problem. Accidental discharge, often with fatal results, occurs by someone handling a weapon which was "supposed" to be on safety or, alternatively, which had its magazine removed and was supposed to be empty. Accordingly, much attention has been given, by designers, manufacturers and others skilled in the art of manufacture and use of semi-automatic firearms, to their construction or adaptation so as to avoid or mitigate the danger of accidental or inadvertent firing.

The present invention further addresses this problem and provides the art with unique improvements in firearm construction that accomplishes this desired result.

The majority of semi-automatic pistols in use, including those used as side-arms by the armed forces of the United States of America, are of the essentially single action type in which a firing pin, typically impacted by a hammer, is cocked into firing position by recoil of a slide when the weapon is discharged by pull of the trigger (see U.S. Pat. Nos. 984,519 and 4,754,689). Some of these weapons may be double action on loading of the first round, but single action thereafter for all rounds in the magazine, i.e., they are not double action only weapons.

Such single action pistols are notorious for accidental discharge and various embodiments have been devised to improve their safety. This has included modification of the sear mechanism to reduce potential for movement on dropping or other impact of the weapon (see U.S. Pat. No. 4,646,619) and disablement of the trigger upon removal of the magazine (see U.S. Pat. No. 4,420,899).

Double action type pistols are those in which the firing pin is not cocked by slide recoil, but wherein trigger movement both cocks and releases the firing pin for weapon discharge (see U.S. Pat. No. 3,857,325). Since such pistols are not "armed" until trigger pull, they have less potential for accidental discharge upon being dropped or impacted. Still, accidental discharge is possible in such firearms and embodiments of them have been created to improve their safety, e.g., disablement of the trigger upon removal of the magazine (see U.S. Pat. No. 4,031,648). The present invention improves upon the inherent safety features of double action type firearms by provision of improvements thereto that virtually eliminate the possibility of their accidental discharge by dropping or impact or because there was a cartridge in the chamber of a gun from which the magazine had been removed.

One manner in which better safety in use and aiming of pistols has been attained by this invention is to improve tactile aspects of trigger operation so that the operator can have positive, constant "feel" control of discharge. However, this is accomplished without substantially increasing trigger pull effort by the use of roller bearings in structuring of trigger, sear and firing pin mechanisms. This appears to be a new innovation in construction of pistols.

Another manner in which the invention improves upon double action firearms is to interlock the slide and barrel into a system that is not dependant on the frame or frame side rails for proper alignment or function. This has been done by utilizing rotary barrel and slide interlock lugs (see U.S. Pat. Nos. 1,427,966 and 4,522,107) in a novel arrangement.

A further manner of the invention for improvement of semi-automatic, double action pistols or other firearms is through the use of an elongated, pivoted linkage unit between the trigger and the sear. Such linkages have been used in prior firearms (see U.S. Pat. Nos. 566,513; 1,395,455; 2,139,203; 4,301,609; 4,358,987 and 4,825,744), but the present invention provides novel forms of such know type of firearm units to create the new, improved semi-automatic, double action only guns.

OBJECTS

A principal object of the invention is the provision of new semi-automatic firearms with improved safety features.

Further objects include the provision of:

1. Improved hammerless pistols or other semi-automatic hand-guns wherein a firing pin is both cocked and released for firing by a trigger mechanism in contrast to the predominate type of semi-automatic guns in which a firing pin or related hammer is cocked by the recoil of the gun.

2. New semi-automatic hand-guns having triggers, sears and firing pins that operate with relative low and more constant friction as compared with prior known hand-guns.

3. Such hand-guns that include a unique plunger assembly for positioning of the gun slide.

4. Such hand-guns that provide for a constant, smooth trigger pull.

5. Such hand-guns in which the firing pin is positively blocked and prevented from reaching the cartridge until the barrel has been safely locked in battery position.

6. A hand-gun mechanism that insures the trigger has moved into a full-forward position before the sear can reengage the firing pin for subsequent discharge of the weapon.

7. Semi-automatic hand-guns having a dual purpose sear which functions to make the weapon drop safe.

8. Semi-automatic and-guns having an interrelated slide, barrel and cam block independent of the gun frame so that the frame is not subjected to any loads induced on it by locking and unlocking of the slide and barrel.

Other objects and further scope of applicability of the present invention will become apparent from the detailed descriptions given herein; it should be understood, however, that the detailed descriptions, while indicating preferred embodiments of the invention, are given by way of illustration only, since various changes and modifications within the spirit and scope of the invention will become apparent from such descriptions.

SUMMARY OF THE INVENTION

The objects are accomplished in accordance with the invention by the provision of semi-automatic, double action only pistols or like firearms that comprise (a) an elongated frame having a generally U-shaped, axial cavity and an axial slideway defining an upwardly facing longitudinal opening therein and (b) an elongated slide mounted on the frame for movement along the slideway between a slide battery position and a slide recoil position.

There is (c) a drive spring assembly housed in the cavity biasing the slide into the slide battery position, (d) a barrel is rotatably and slidingly carried in the slide and (e) cam means rotates the barrel between a barrel battery position and a barrel recoil position.

The barrel can slide axially in the slide when in the barrel recoil position and (f) integral lugs extend laterally from the barrel to prevent its axial movement in the slide when in the barrel battery position. A barrel bushing releasably fitted to the muzzle of the pistol slideably centers the barrel in the slide.

The pistol additionally has (g) a firing pin assembly including a firing pin carried in the slide for axial movement between a retracted position and a firing position through a safety position and (h) a firing pin safety block assembly that positively prevents the firing pin from reaching the firing position until the barrel has fully rotated into the barrel battery position including a stop lever pivoted on the slide.

In preferred embodiments, the pistol has (i) a trigger assembly that includes a trigger that reciprocates axially in the frame, a sear pivoted to the trigger for reciprocation therewith, and roller bearings supporting the trigger and sear in the frame for such reciprocation. Additionally, the firing pin assembly includes a roller bearing at least partially supporting the firing pin in the slide.

The trigger assembly also includes (j) means that permits the sear to engage the firing pin when the sear moves away from the firing pin firing position, but prevents the sear from engaging the firing pin when the sear moves toward the firing pin firing position. Such means includes a plunger that holds the sear out of contact with the firing pin when the sear moves toward the firing pin firing position.

Preferably the sear comprises an elongated flat strip member having a first leg extending from its distal end plus an upper second leg and lower third leg extending from its proximal end, a firing pin engagement lug that extends laterally from the second leg, and a cam surface on the third leg. The frame carries a roller cam that engages the cam surface to cause the sear to pivot downward as the sear approaches the end of the movement of the sear away from the firing pin firing position and the sear is pivoted to the trigger by the first leg.

Advantageously, the frame includes a plunger that is spring biased to move normally relative to the slide to engage with an indentation in the slide to thereby aid in the full closing of the slide into the slide battery position.

BRIEF DESCRIPTION OF THE DRAWINGS

A more complete understanding of the invention can be obtained by reference to the accompanying drawings in which.

In so far as possible, the same numeral is used to identify identical and the same numeral with a trailing letter is used to identify similar components appearing in the separate figures.

DESCRIPTION OF THE PREFERRED EMBODIMENTS

Figure 1:
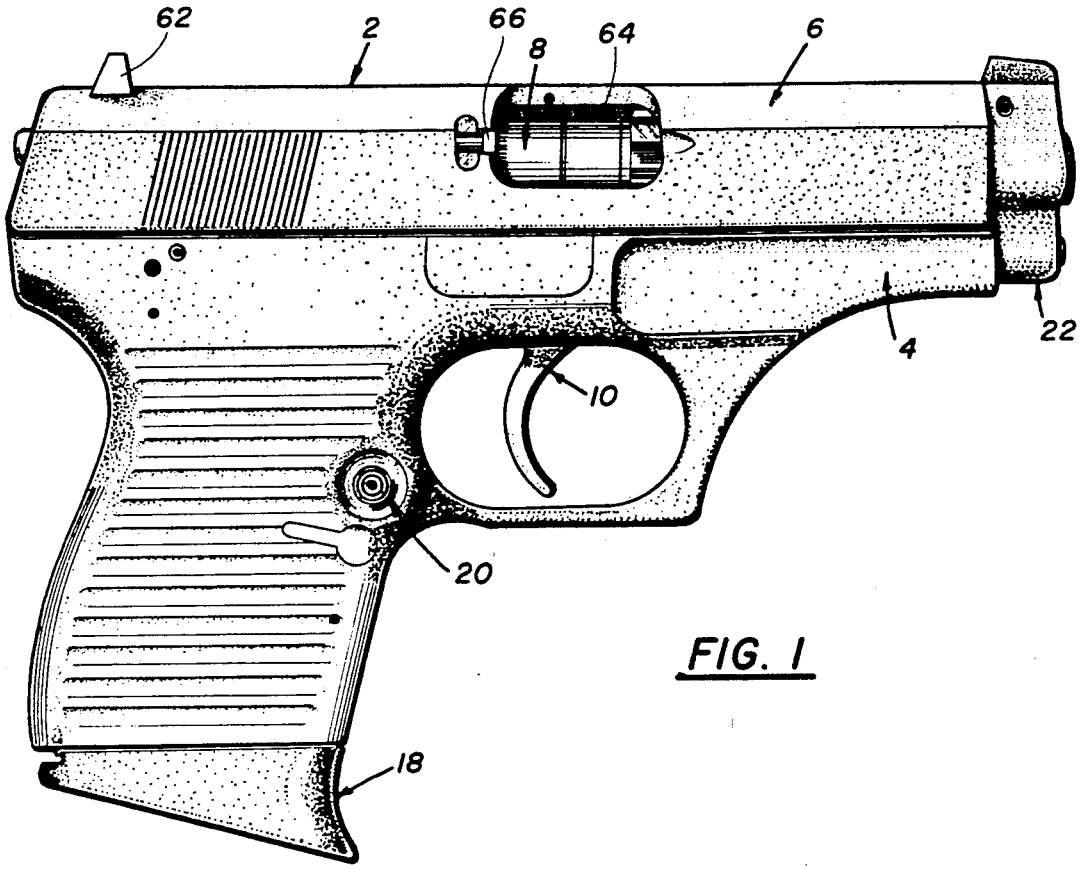
FIG. 1 is a lateral view of the right side of a double action only, semi-automatic pistol of the invention.

With reference in detail to the drawings, the semi-automatic, double action only pistol 2 basically comprises frame 4, slide 6, barrel 8, trigger assembly 10, firing pin assembly 12, sear 14, ejector 15, drive spring assembly 16, magazine 18, magazine release unit 20, barrel bushing 22, cam block 24 and slide stop unit 26.

The elongated frame 4 has a generally U-shaped, axial cavity 28 along which the axial slideway 30 defines an upwardly facing longitudinal opening 32. The slideway 30 consists of right and left parallel channels 34 machined into the top sides 36 of the frame 4.

The frame 4 also comprises a trigger guard 38, right and left grip portions 40, trigger slideway 42, saddle 44 for the cam block 24, magazine chamber 46, a cut-out portion 48 to receive the stop unit 26, a bore 50 to journal the hub 52 of the stop unit 26 and pin bores 54 & 56.

Figure 5:
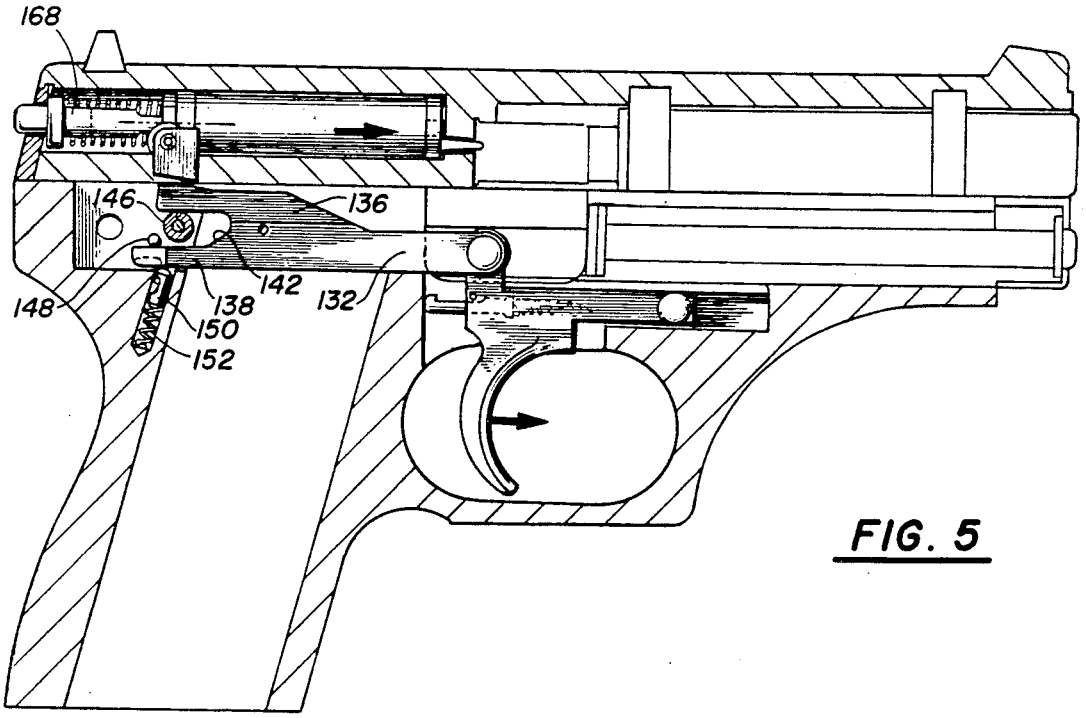
FIG. 5 is a sectional view of the pistol of FIG. 1 with the trigger and related parts in the forward travel position.
Figure 10:
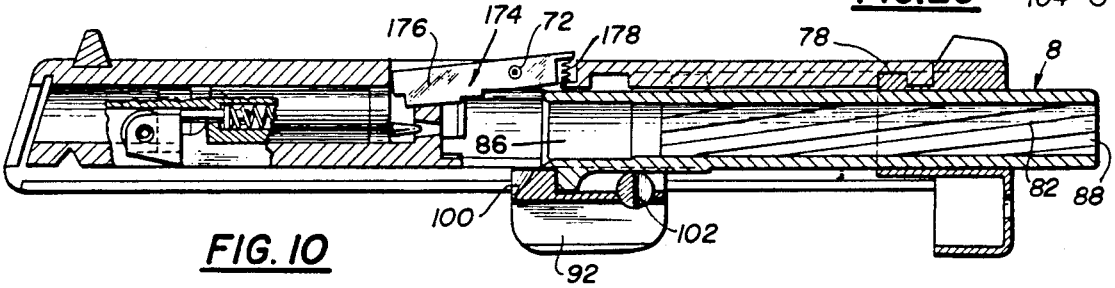
FIG. 10 is a sectional view showing the slide of the pistol retracting along the barrel following discharge of the pistol.
Figure 12:
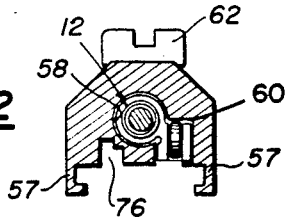
FIG. 12 is a sectional view taken on the line XII—XII of FIG. 11.
Figure 14:
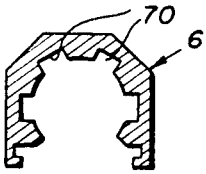
FIG. 14 is a sectional view taken on the line XIV—XIV of FIG. 11.
Figure 13:
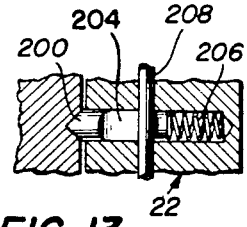
FIG. 13 is a sectional view taken on the line XIII—XIII of FIG. 11.
Figure 11:
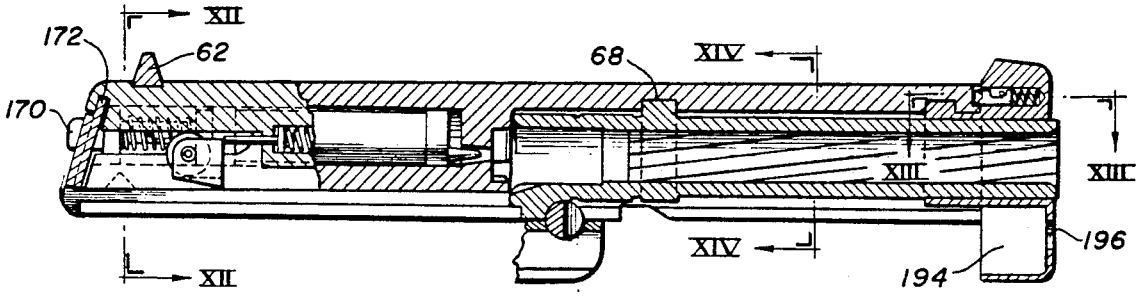
FIG. 11 is a sectional view similar to FIG. 9, but with emphasis on different parts than FIG. 9.
Figure 22:
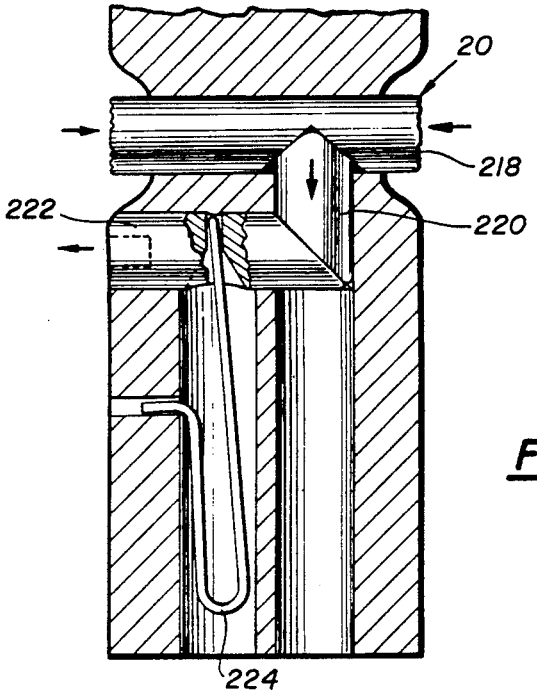
FIG. 22 is a fragmentary, sectional view of a magazine release assembly in the pistol.
Figure 23:
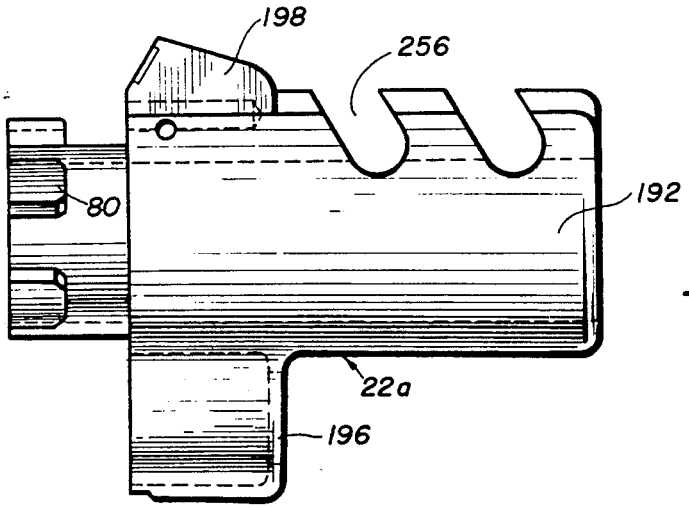
FIG. 23 is a right side view of a barrel bushing of the pistol.
Figure 24:
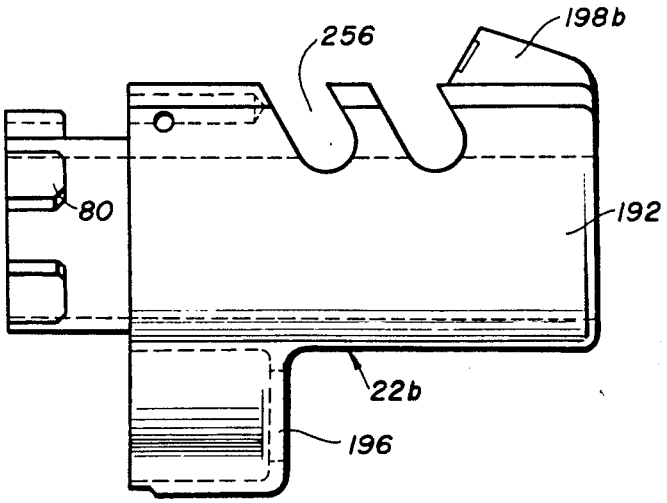
FIG. 24 is a right side view of another barrel bushing.

The elongated slide 6 mounts on the frame 4 for movement along the slideway 30 between a slide battery position as shown in FIG. 5 and a slide recoil position as shown in FIG. 10 by having its axial channel portions 57 (see FIG. 12) engage the axial channels 34 of the frame 4. The drive spring assembly 16 is housed in the cavity 28 to bias the slide 6 into the slide battery position.

The slide 6 additionally comprises a bore 58 and channel 60 to receive the firing pin assembly 12, a rear sight 62, a cartridge ejection opening 64, cartridge ejector 66, semi-circular barrel lug locking channel 68, axial barrel lug slide channels 70, retention pin bore 72, grip serrations 74, complex axial channel 76 and a semi-circular channel 78 to receive lugs 80 of the barrel bushing 22.

Figure 9:
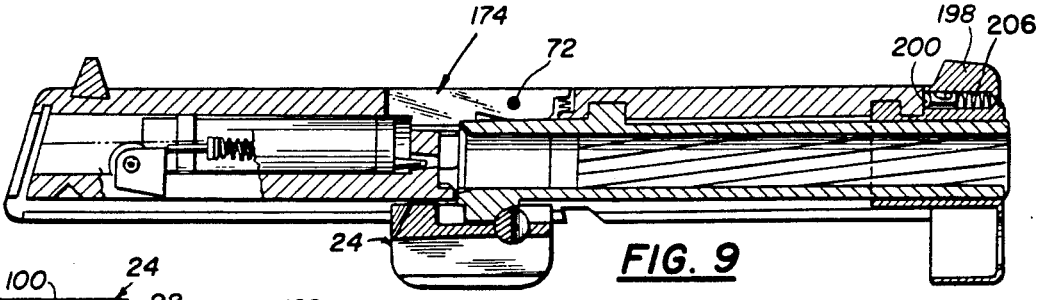
FIG. 9 is a sectional view showing the slide and barrel of the pistol with internal parts positioned as shown in FIG. 6.
Figure 15:
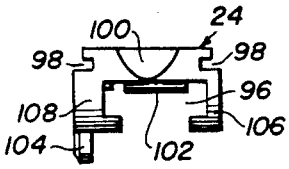
FIG. 15 is a rear end view of the cam block of the pistol.

The barrel 8 is rotatably and slidingly carried in the slide 6. It comprises rifling 82, lateral lugs 84, breech 86, muzzle 88, bevel 90 and cam 92. In the barrel battery position (see FIG. 9), the lugs 84 lock in the slide locking channel 68, while in the barrel recoil position (see FIG. 10), the lugs 84 slide in the slide channels 70.

Cam means 24 rotates the barrel 8 between barrel battery position and a barrel recoil position. Thus, in the assembled pistol 2, the barrel cam 92 rests in the cam slot 94 and as the slide 6 begins to recoil interaction between cam 92 and slot 94 causes the barrel 8 to rotate clockwise (as viewed from the breech) about 10° so the lugs 84 turn out of the channel 68 and into the channels 70. Conversely, as the slide 6 nears battery position, movement of the cam 92 in slot 94 rotates the barrel 8 counter-clockwise so the lugs 84 turn into the channel 68 to prevent its axial movement in the slide when in the barrel battery position.

As seen in FIGS. 15–20, the cam means 24 includes an internal, longitudinal channel 96, external longitudinal channels 98, bevel 100, lock bar 102, lock lever 104, right shoulder 106 and left shoulder 108. In the assembled pistol 2, the shoulders 106 and 108 rest on the saddle 44 of frame 4 and in this position, the channels 98 form a part of the slideway 30.

The bevel 100 serves as a guideway in loading a cartridge from the magazine 18 into the breech 86.

Figure 16:
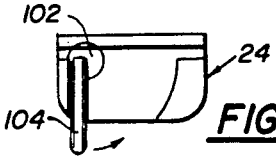
FIG. 16 is a left side view of the cam block.
Figure 17:
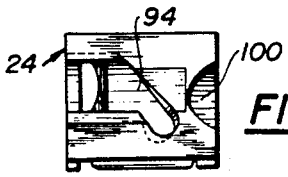
FIG. 17 is a plan view of the cam block.
Figure 18:
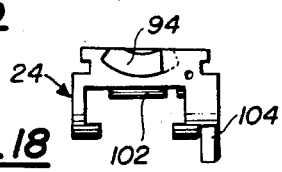
FIG. 18 is a front end view of the cam block with a lock lever in down position.
Figure 19:
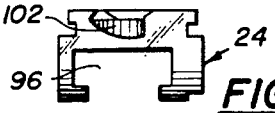
FIG. 19 is a front end view of the cam block with a lock lever in up position.
Figure 20:
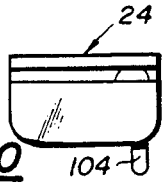
FIG. 20 is a right side view of the cam block.

FIGS. 16, 17 & 19 show the lock bar 102 and lever 104 in the slide lock position, while FIGS. 18 & 20 show them in the slide unlock position which permits the slide 6 to move forward and out of the slideway 30 for disassembly of the pistol 2. Thus, as seen in FIG. 19, in the lock position, the lock bar 102 closes the entrance into the cam slot 94 to thereby prevent the barrel lug 92 for moving out of the slot 94, but in the unlock position (FIG. 18), the shape of the lock bar 102 is such that entrance to the cam slot 94 is open and the lug 92 can pass to permit the barrel 8 and slide 6 to move forward on the slideway until they become free of the frame 4.

Figure 7:
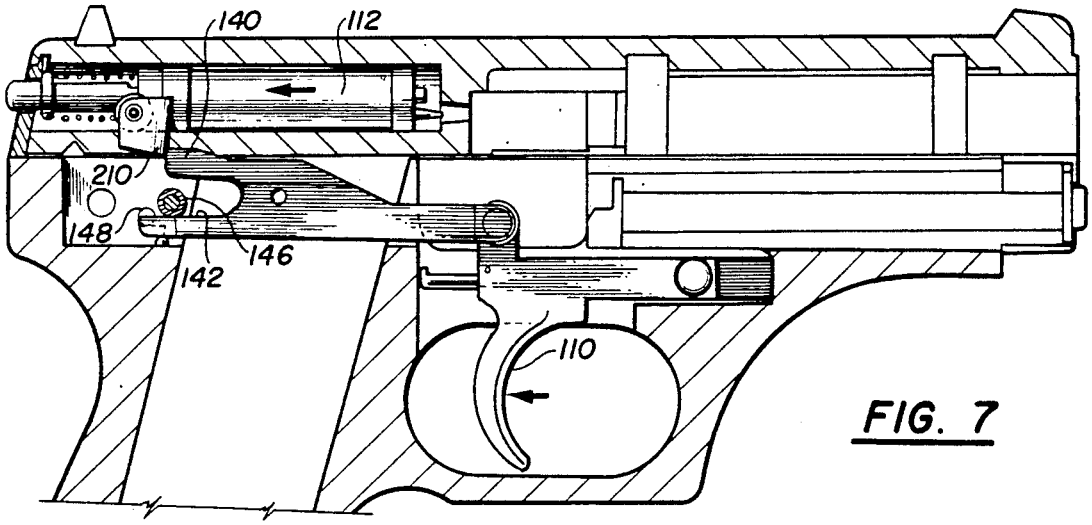
FIG. 7 is a sectional view showing the trigger and related parts advancing from the position of FIG. 6 toward the position of FIG. 4.
Figure 8:
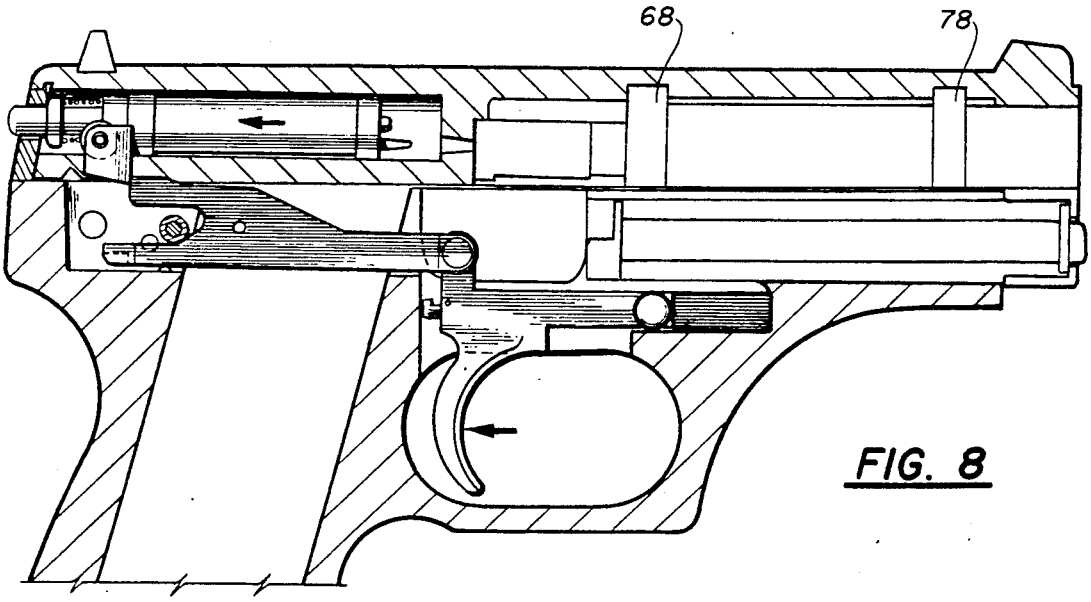
FIG. 8 is a sectional view showing the trigger and related parts advancing from the position of FIG. 7 toward the position of FIG. 4.

The trigger assembly 10 includes the trigger 110 that reciprocates axially in the frame 4 and the sear 14 pivoted to the trigger 110 for reciprocation therewith. Additionally, the assembly 10 comprises a longitudinal portion 112, depending finger portion 114, plunger 116 and roller bearings 118. The portion 112 has an axial bore 120 that slideably receives the plunger 116 and contains a coil spring 122 to urge the plunger out of portion 112. The frame 4 has a pair of axial grooves 124 juxtaposed to the trigger slideway along which the roller bearing run when the trigger is pulled (see FIGS. 6–8).

The trigger assembly further has a second pair of roller bearings 126 carried on the pin 128 fixed in the post 130 that extends up from the assembly portion 112. The bearings 126 run in the cam means channel 96.

The sear 14 comprises an elongated flat strip member having a first leg 132 extending to its distal end 134 plus an upper second leg 136 and lower third leg 138 extending to its proximal end. The sear is pivoted at its end 134 on the pin 128 fixed to the trigger post 130.

A firing pin engagement lug 140 extends laterally from the second leg 136 and there is a cam surface 142 and a lateral lug on the third leg.

Figure 4:
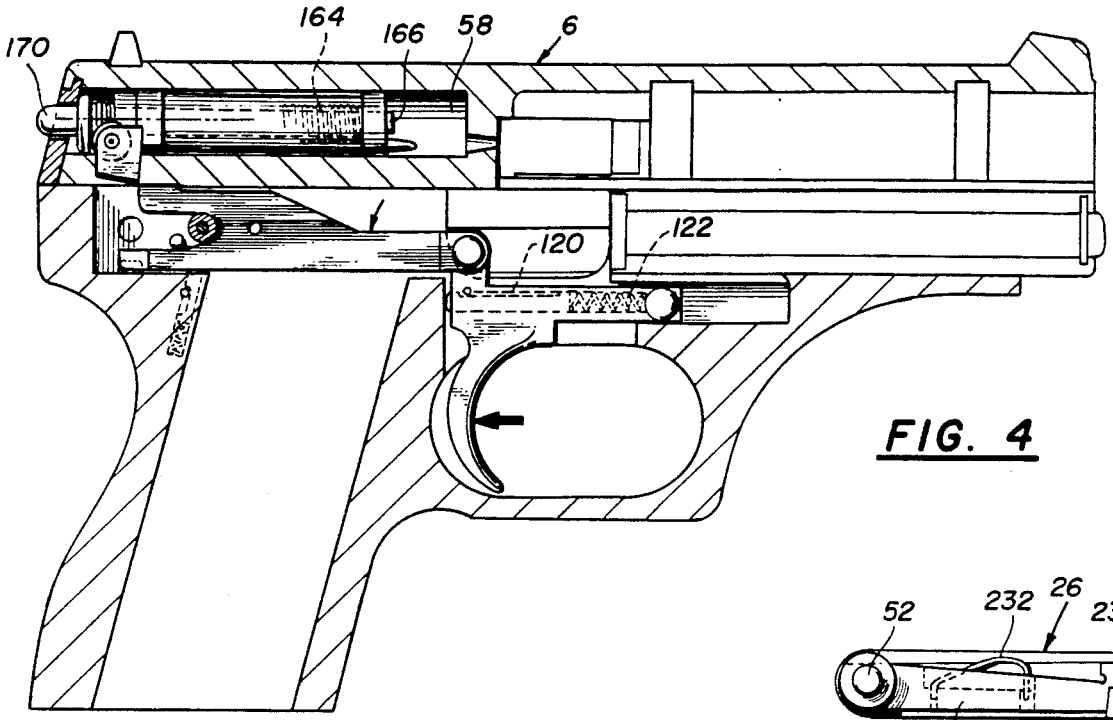
FIG. 4 is a sectional view of the pistol of FIG. 1 with the trigger in the full rear travel position at sear release.
Figure 21:
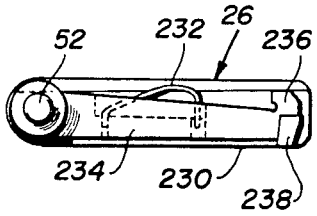
FIG. 21 is right side view of the slide stop lever of the pistol.

The frame 4 carries several items essential to the proper operation of the sear 14, namely (1) a roller cam 146 that engages the cam surface 142 to cause the sear to pivot downward as the sear approaches the end of its movement away from the firing pin firing position (see FIG. 4), (2) plunger 148 that reciprocates normal to the plane of movement of the sear 14 and (3) plunger 150 with bias spring 152 that reciprocates in the plane of movement of the sear 14. The interaction of these items as explained later by reference to FIGS. 4–8 permits the sear to engage the firing pin when the sear moves away from the firing pin firing position, but prevents the sear from engaging the firing pin when the sear moves toward the firing pin firing position.

The roller 146 rotates on a pin carried in the frame bore 56. The plunger reciprocates in the frame bore 54 which carries a bias spring (not shown) similar to spring 152.

The firing pin assembly 12 comprises a cylindrical case 154, a bracket 156 that extends laterally from case 154 to hold a roller bearing 158, the firing pin 160 and a spring unit 162.

The spring unit 162 has a coil spring 164 captured between a front guide member 166, the tip of which extends though a hole in the front of case 154, and a rear guide member 168, the end of which carries a ledged cap 170. The members 166 & 168 telescope together when the spring 164 is compressed by pull of the trigger 110.

Figure 6:
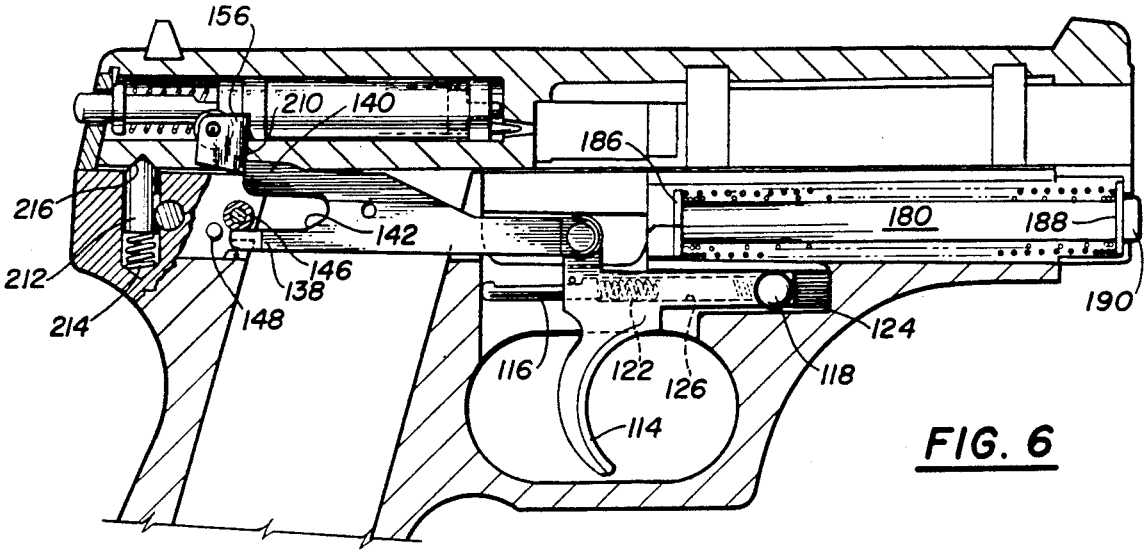
FIG. 6 is a sectional view similar to FIG. 5, but with the trigger and related parts in forward position after full return of the slide following discharge of the pistol.

When the pistol 2 is assembled, the case 154 of firing pin assembly 12 fits into the slide bore 58 and the bracket 156 and bearing 158 fit into the slide channel 60. An end plate 172 slips into grooves (not shown) in the rear of the slide 6 and the end of cap 170 protrudes though a hole in the plate 172 to lock these parts in place. When so assembled in the pistol 2, the firing pin assembly 12 is carried in the slide 6 for axial movement between a retracted position (FIG. 4) and a firing position (FIG. 5) through a safety position (FIG. 6).

Pistol 2 has a firing pin safety block assembly 174 that positively prevents the firing pin 160 from reaching the firing position until the barrel 8 has fully rotated into the barrel battery position. This assembly 174 includes a stop lever 176 pivoted on the slide pin 72 and biased into the firing pin blocking position (see FIG. 10) by a spring 178. The bevel 90 on barrel 8 allows lever 176 to pivot into the blocking position when the barrel is rotated into its recoil position, but when the barrel rotates into its battery position the bevel 90 moves aside and the full outside diameter of the barrel breech 86 pushes lever 176 up so the firing pin case 154 can clear it permitting the firing pin 160 to engage and fire a cartridge.

The drive spring assembly 16, which is housed in the U-shaped, axial cavity 28 of the slide 6, serves to return the slide to the battery position after recoil upon discharge of the pistol 2. This assembly 16 comprises a longitudinal guide rod 180 surrounded by an inner drive spring 182 and an outer drive spring 184. The springs are captured between a contoured cap 186 pinned to the rear end of rod 180 and the washer 188 that is slideable on the rod 180, but prevented from sliding off rod 180 by the enlarged end 190.

The drive spring assembly 16 is captured in the cavity 28 by the barrel bushing 22 which comprises, in addition to the lugs 80, the barrel chambering bore 192, the drive spring chambering bore 194 with the hole 196 in its forward end, the front sight 198, locking plunger 200 with land 204 and its bias spring 206 plus retainer pin 208.

When assembled in the pistol 2, the washer 188 of assembly 16 abuts the front end of the bore 194 in bushing 22 and the end 190 of rod 180 protrudes through hole 196. Thus, with the bushing 22 locked on the slide 6 by its lugs 80 plus plunger 200, the forward end of barrel 8 is slideably carried in bore 192 and the forward end of drive spring assembly is captured in the bore 194 (see FIG. 6). When the pistol 2 is discharged, the slide 6 recoils and moves back along the barrel 8 as its front portion slides in bore 192 of bushing 22 (see FIG. 10). At the same time, the springs 182 & 184 of assembly 16 are compressed until the slide 6 reaches the full recoil position (not shown) whereupon the springs 182 & 184 return the slide to the battery position. This, in turn, causes the barrel 8 to be moved into its battery position by action of cam block 24 as previously described.

The recoil of the slide 6 as described discharges a spent casing from the pistol 2 though the ejection opening 64 and loads a new cartridge (not shown) from the magazine 18 into the barrel breech 86, but since the pistol 2 is a double action only firearm, the recoil does not cock the firing pin 160 which remains in its safety position (see FIG. 9) throughout the entire recoil movement of the slide 6. This safety improvement in the new semi-automatic pistol is attained by the unique features and mode of operation of the trigger assembly 10 and sear 14 which can be described with reference to FIGS. 4–8.

The safety position of the firing pin assembly 12 is shown in FIG. 6 where the rear end of firing pin engagement lug 140 of sear 14 engages the front ledge 210 of firing pin assembly bracket 156. Also, roller cam 146 engages cam surface 142 of leg 138 while plunger 148 is disengaged. Thus, as the trigger 110 begins to be pulled, engagement of lug 140 with ledge 210 causes the firing pin assembly 12 to be moved rearward (see FIG. 7) while cam surface 142 continues to run along roller 146, but plunger 148 is by-passed and begins to ride behind leg 138 with the sear 14 biased upwardly by plunger 150. Further pull of trigger 110 eventually moves the firing pin assembly 12 to its rearmost position just before the sear disengages (see FIG. 8). At this point, cam roller 146 riding on the cam surface 142 forces the sear 14 downward overcoming the bias of plunger 150 and two things immediately occur, namely, (1) the engagement lug 140 on sear 14 disengages from the ledge 210 of the firing pin assembly 12 and (2) the plunger 148 moves laterally across the top of sear leg 138(see FIG. 4). Immediately, the firing pin assembly flies toward the firing pin battery position (see FIG. 5). Also, as soon as finger pressure on the trigger 110 is released, the sear moves forward, but plunger 148 continues to ride on the top of cam surface 142 of leg 138 thereby preventing the sear 14 from moving upward until it reaches its full forward position and clears the plunger 148 (see FIG. 6). This insures safety in the pistol 2 by requiring the trigger 110 to move fully forward before the sear lug 140 can reengage the ledge 210 of the firing pin assembly 12 for subsequent shots of the pistol 2.

There are other features built into the firing pin assembly 12, trigger assembly 10 and sear 14 that combine with the described novel sear action to provide the improved safety to the new pistols of this invention. Thus, the tactual characteristics of trigger action in the new pistols serve to increase safety of operation. Firstly, the use of roller bearings 118 & 126 for support of the trigger and sear reduce friction and operate in a straight motion not having to cam or lever any other trigger part significantly. This results in a substantially constant tactual sensation to the pistol operator spread over a recognizable period of time and eliminates accidental, unintentional discharge of the weapon by a "nervous finger" gun user.

Secondly, the spring 164 in assembly 12 is a low-rate type which combines with the roller bearings to provide for the constant, smooth trigger pull that eliminates unintentional discharge of the weapon via trigger pull per se.

A third feature contributing to safety in the new pistols of the invention is the inclusion in the frame 4 of plunger 212 that is biased by spring 214 to move normally relative to the slide 4 to engage with matching detent 216 in the slide 4 to aid in the full closing of the slide into its battery position insuring that the pistol 2 is ready to fire. The amount of pressure required to overcome the initial opening resistance of the slide 4 is controlled by regulation of the tension in spring 214. Incorporation of plunger 212 in pistol 2 is a preferred option.

The magazine 18 is carried in the grip portion 40 of the frame 4 and may be released from therefrom by pressing on either the right or left side of the release button 218 that extends laterally through the grip portion 40 and forms part of the release assembly 20 which additionally comprises contoured plunger 220, magazine latch bar 222 and spring 224. Movement of button 218 in either direction from its rest position depresses plunger 220 causing latch bar 222 to move against the bias of spring 224 out of the slot 226 in the magazine 18 freeing it for withdrawal from the grip portion 40 of pistol 2. Other less complex arrangements may be used for magazine release, e.q., a system (not shown) that only releases from one side, but is changeable for right or left handed users.

The slide stop unit 26 serves to lock the slide 4 in the full recoil position when the magazine 18 is empty. This is an added safety feature that warns a shooter that the next pull of the trigger 110 will not result in firing of the pistol. In addition to post 52, unit 26 includes lever 230, cantilever wire spring 232, spring housing 234, hook portion 236 and lug 238 that functions with ledge 240 on the cartridge plunger 242 of magazine 18. The lug 238 is sized so that it does not engage cartridges (not shown) loaded in the magazine 18, but does engage the ledge 240 when plunger 242 is pushed to its top position by spring 244. When this occurs, on the next recoil of slide 4, the hook portion 236 locks into the notch 246 in slide 4 and prevents the slide from returning to its battery position. Removal of the empty magazine automatically returns lever 230 to its lower position to unlock the slide 4 under the action of spring 232. The tension of spring 232 is less than the tension of magazine spring 244 permitting the lever 230 to be raised against the downward pressure of spring 232 when the magazine is emptied.

The ejector 15 functions to eject spent cartridges from the pistol 2 through the opening 64 following discharge of the pistol and as the slide 6 recoils. It comprises finger 248, body 250 and depending mount 252 containing hole 254. When assembled in the pistol 2, the post 52 extends through the hole 254 to fix ejector 15 in the frame 4 to ride in the complex channel 76 in the slide 6 as the slide reciprocates.

The pistol 2 may be provided with a long barrel (not shown) identical to barrel 8, but about 1 inch longer in length to function with longer barrel bushings 22*a* and/or 22*b*. Both longer bushings have a pair of gas exhaust slots 256 therein and are essentially the same except for position of mount of the front sight 198 or 198*b* and the spacing of the exhaust slots 256.

Figure 2:
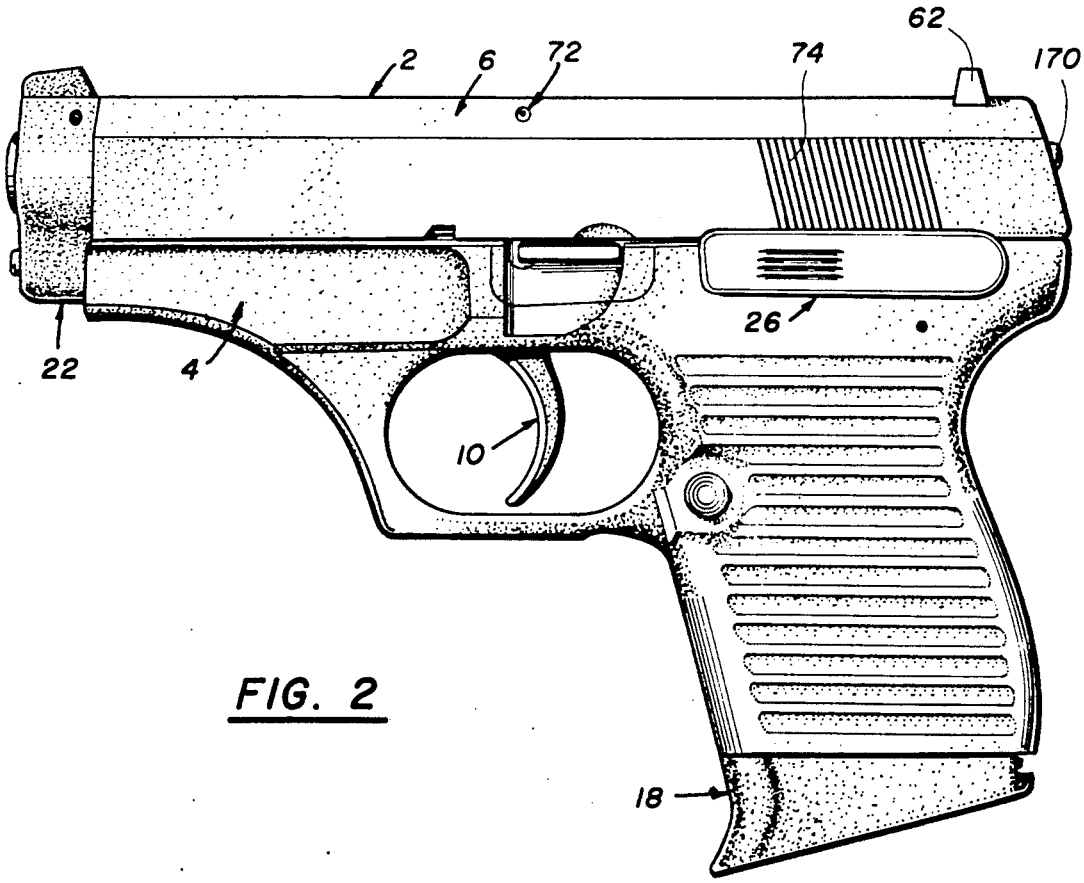
FIG. 2 is a lateral view of the left side of the pistol of FIG. 1.

A pistol 2 equipped with both short and long barrel and regular and longer barrel bushings may be operated in four different modes, namely (1) standard service mode with short barrel 8 and regular bushing 22 as shown in FIGS. 1 & 2, (2) compensated mode with short barrel 8 and longer bushing 22*a* or 22*b*, (3) target shooting mode with long barrel and longer bushing 22*a* or 22*b* and (4) silencer mode with regular bushing 22 and longer barrel having a silencer fitted to the exposed mussle of the longer barrel. In the compensated mode, gas discharging through the slots 256 assists the shooter to hold the gun muzzle down against the upward thrust on recoil.

Figure 3:
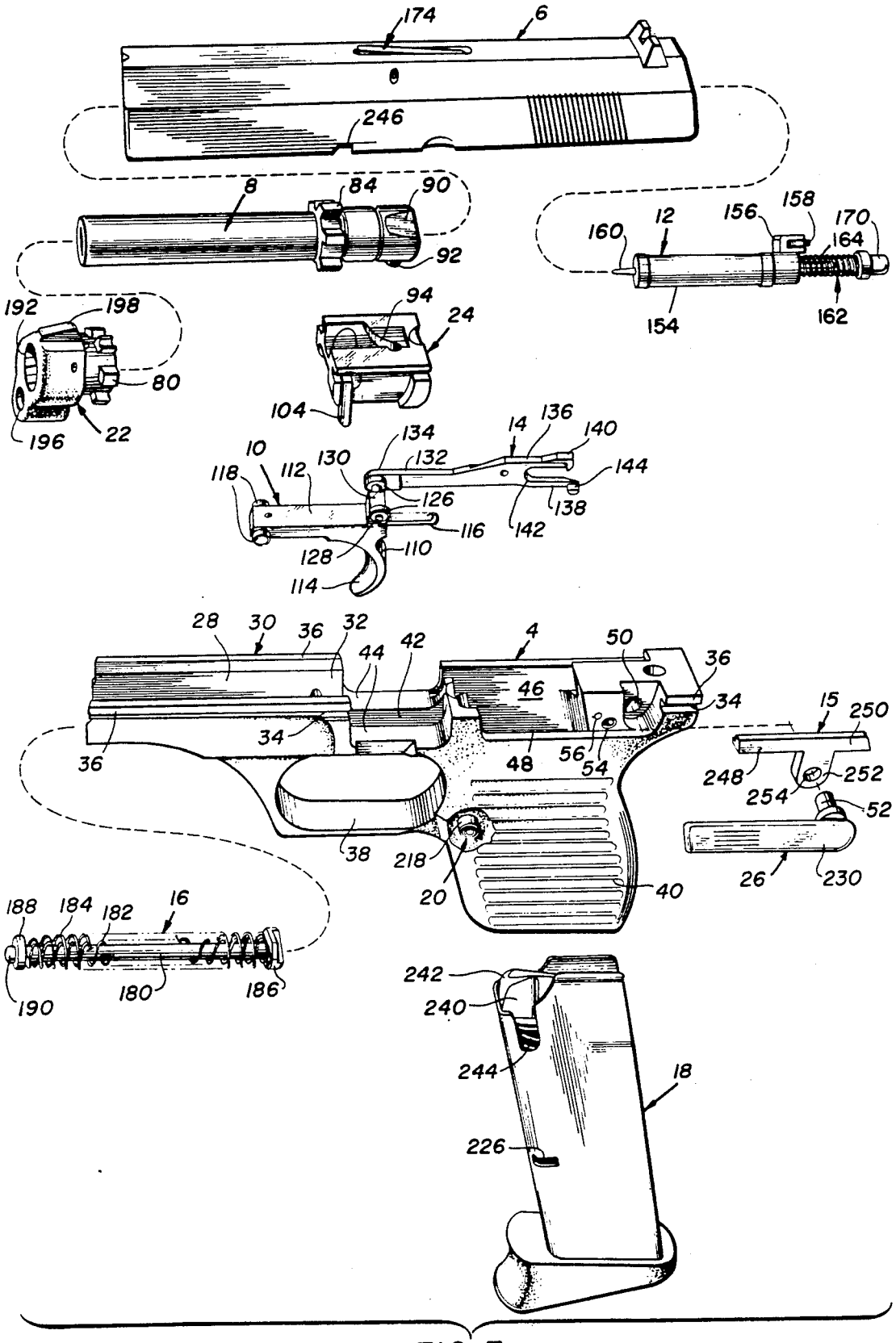
FIG. 3 is an exploded view of the pistol of FIG. 1.

The pistol 2 is easy to maintain and service. Thus, it is easily disassembled by swinging the lever 104 down as seen in FIG. 3. The permits the barrel lug 92 to exit the cam slot 94 and the slide to move forward and off the slideway 30, provided the magazine 18 has been removed from the grip portion 40. With the slide removed, drive spring assembly 16 drops off the slide 6. The barrel 8 is removed from slide 6 by rotation of bushing 22 to unlock its lugs 80 from the slide groove 78.

Firing pin assembly 12 is removed from slide 6 by pressing in cap 170 on assembly 12 and sliding the retainer 172 off the slide 6. Trigger assembly 10, sear 14 and cam block 24 are pulled off the saddle 44 as a unit and when free of the frame 4, cam block 24 can be separated from the trigger assembly 10 and sear 14. Removal of slide 6 also permits stop unit 26 and ejector 15 to be pulled off the frame 4.

Servicing of several parts, e.g., items 146, 148 & 174 require the removal of retention small pins by use of tools, but otherwise, the pistol may be assembled and disassembled by hand without use of tools.

The embodiments of the invention in which an exclusive property or privilege is claimed are defined as follows:

1. A semi-automatic, double action only firearm comprising:

an elongated frame having an axial slideway therein and a grip portion, an elongated slide mounted on said frame for movement along said slideway between a slide battery position and a slide recoil position, a firing pin assembly including a firing pin carried in said slide for axial movement between a retracted position and a firing position through a safety position, and a trigger assembly including:

a trigger that reciprocates axially in said frame, a sear reciprocated axially in said frame by said trigger, and means that permits said sear to engage said firing pin when said sear moves away from said firing pin firing position, but prevents said sear from engaging said firing pin when said sear moves toward said firing pin firing position, said sear comprises an elongated flat strip member having a first leg extending from its distal end plus an upper second leg and lower third leg extending from its proximal end, a firing pin engagement lug that extends laterally from said second leg, and a cam surface on said third leg and, said frame carries a roller cam that engages said cam surface to cause said sear to pivot downward as said sear approaches the end of said movement of said sear away from said firing pin firing position.

2. The firearm of claim 1 wherein said sear is pivoted to said trigger by said first leg.

3. The firearm of claim 1 wherein said means includes a plunger that holds said sear out of contact with said firing pin when said sear moves toward said firing pin firing position.

4. The firearm of claim 1 wherein said frame includes a plunger that is spring biased to move normally relative to said slide to engage with an indentation in said slide to thereby aid in the full closing of said slide into said slide battery position.

5. The firearm of claim 1 that carries a magazine in said grip portion of said frame that may be released from said grip portion by pressing on either the right or left side of a release button that extends laterally through said grip portion.

6. A semi-automatic, double action only firearm comprising:

an elongated frame having a generally U-shaped, axial cavity and an axial slideway defining an upwardly facing longitudinal opening therein, a grip portion, an elongated slide mounted on said frame for movement along said slideway between a slide battery position and a slide recoil position, a drive spring assembly housed in said cavity biasing said slide into said slide battery position, a barrel rotatably and slidingly carried in said slide, cam means to rotate said barrel between a barrel battery position and a barrel recoil position wherein said barrel can slide axially in said slide, integral lugs that extend laterally from said barrel to prevent its axial movement in said slide when in said barrel battery position, a firing pin assembly including a firing pin carried in said slide for axial movement between a retracted position and a firing position through a safety position, and a trigger assembly including:

a trigger that reciprocates axially in said frame, a sear reciprocated axially in said frame by said trigger, said sear comprises an elongated member having a first leg extending from its distal end plus an upper second leg and lower third leg extending from its proximal end, a firing pin engagement lug that extends laterally from said second leg, and a cam surface on said third leg located in a groove formed between said second and third legs, and means that permits said sear to engage said firing pin when said sear moves away from said firing pin firing position, but prevents said sear from engaging said firing pin when said sear moves toward said firing pin firing position.

7. The firearm of claim 6 wherein roller bearing support said trigger and sear for said reciprocation.

8. The firearm of claim 7 wherein said firing pin assembly includes a roller bearing at least partially supporting said firing pin in said slide.

9. A firearm comprising:

a frame;

a barrel connected to said frame;

a trigger movably mounted to said frame;

a firing pin assembly movably mounted to said frame; and means for allowing selective operable engagement between said trigger and a portion of said firing pin assembly, said means including a sear pivotally connected to said trigger having a cam surface, and a roller cam fixedly connected to said frame, said sear being at least partially longitudinally movable with said trigger and, said sear, cam surface and roller cam being suitably adapted such that, as said trigger is longitudinally moved from a forward position, said sear can longitudinally move said firing pin assembly and, at a predetermined distance from said forward position, said sear can be pivoted away from operable engagement with said firing pin assembly by camming action of said cam surface and said roller cam to thereby release said firing pin assembly.

10. A firearm comprising:

a frame, a barrel connected to said frame; and a firing mechanism connected to said frame, said firing mechanism having a trigger assembly, a firing pin assembly, and a roller cam, said trigger assembly having a sear with a first leg, a second leg, a groove therebetween, and a cam surface for contacting said roller cam, said sear being adapted to move in said frame with said roller cam in said groove such that engagement of said roller cam with said cam surface can move said sear out of operable engagement with said firing pin assembly.

11. A firearm having a frame, a barrel, a firing pin assembly and a trigger assembly, the trigger assembly comprising:

a trigger movably mounted to said frame;

a sear pivotally connected to said trigger and being longitudinally movable therewith, said sear having a surface for operably engaging said firing pin assembly;

means for pivotally moving said sear relative to said trigger at a predetermined longitudinal travel thereof to thereby discontinue the operable engagement between said surface and said firing pin assembly, said means for pivotally moving comprising a roller cam connected to said frame operable to move said sear downward; and means for allowing only semi-automatic firing of the firearm including means for locking said sear in a disengaged position until said trigger is moved to a forward position, said means for locking including a laterally movable plunger adapted to prevent said sear from moving upward until said trigger is located in a forward position.

12. A firearm having a frame, a barrel, a firing pin assembly and a trigger assembly, the trigger assembly comprising:

a trigger movably mounted in said frame;

a sear connected to said trigger and being movable therewith in a first direction, said sear having a surface for operably engaging said firing pin assembly;

means for moving said sear relative to said trigger in a second direction to a predetermined disconnect position to thereby discontinue operable engagement between said surface and said firing pin assembly; and means for locking said sear in a disengaged position until said trigger is moved to a forward position, said means for locking comprising a laterally movable plunger connected to said frame adapted to engage said sear and prevent movement of said sear in a third direction, said third direction being opposite to said second direction.

* * * * *